US005725441A

United States Patent [19]

Jensen et al.

[11] Patent Number: 5,725,441

[45] Date of Patent: Mar. 10, 1998

[54] GOLF PUTTER

[76] Inventors: Randy Jensen, 14021 Marinda Plz. No. 3, Omaha, Nebr. 68144; Norman Stoakes, 6831 S. 145th St., Omaha, Nebr. 68137

[21] Appl. No.: 603,230

[22] Filed: Feb. 20, 1996

[51] Int. Cl.[6] ..... A63B 53/04

[52] U.S. Cl. ..... 473/251; 473/286; 473/340

[58] Field of Search ..... 473/249, 251, 473/253, 254, 340, 268, 286

[56] References Cited

U.S. PATENT DOCUMENTS

| | | | |
|---|---|---|---|
| 1,759,622 | 5/1930 | Kenney . | |
| 1,960,110 | 5/1934 | Iles . | |
| 2,057,821 | 10/1936 | Costello | 273/35 |
| 2,501,277 | 3/1950 | Hollopeter | 273/77 |
| 2,723,125 | 11/1955 | Comee | 273/186 |
| 3,708,172 | 1/1973 | Rango . | |
| 3,779,398 | 12/1973 | Hunter . | |
| 3,979,125 | 9/1976 | Lancellotti | 273/186 A |
| 4,135,720 | 1/1979 | Lancellotti | 273/186 A |
| 4,136,877 | 1/1979 | Antonious | 273/164 |
| 4,898,389 | 2/1990 | Plutt | 273/186 A |
| 4,915,385 | 4/1990 | Anderson . | |
| 4,928,971 | 5/1990 | Soles . | |
| 4,930,787 | 6/1990 | Nobles, Jr. | 273/186 A |
| 4,934,702 | 6/1990 | Serizawa . | |
| 5,160,142 | 11/1992 | Marshall | 273/186.2 |

*Primary Examiner*—Sebastiano Passaniti
*Attorney, Agent, or Firm*—John A. Beehner

[57] ABSTRACT

A golf club such as a mallet-style putter has a series of stepped concentric circular cavities formed in the top surface thereof at a generally transversely centered position offset rearwardly from the face of the club to afford improved alignment and optionally convert the putter for use as a training aid by supporting a carried ball on the cavities such that the carried ball will rock or be dislodged if the putting stroke accelerates or decelerates too quickly.

11 Claims, 4 Drawing Sheets

GOLF PUTTER

BACKGROUND OF THE INVENTION

Technical Field

The present invention is directed generally to an improved golf clubhead and more particularly to a mallet-style putter. The clubhead has a series of stepped concentric circular cavities in the top surface thereof to serve both as an alignment-aiming means and as a receptacle for a golf ball when using the putter as a training aid.

Putting problems, particularly with short putts and distance control, are usually caused by misalignment or a tentative decelerating putting stroke. Putters having conventional sight lines which intersect the face of the putter often appear aimed to the right or left depending on right or left eye dominance and/or head position of the golfer. The more short putts a golfer misses, the greater the tendency for him or her to be tentative and to decelerate on the forward stroke. This results in a wobbly swing path, causing pushed or pulled putts. No matter how short or long the putt, it is important that the club accelerate through the ball.

Whereas various training aids are commercially available to assist a golfer in improving his putting stroke, most entail the use of apparatus not normally carried in a golf bag and not readily available to a golfer on a course, at his office, any educational or instructional site or any practice surface.

Accordingly, a primary object of the invention is to provide a golf club with an improved alignment-aiming means stroke perfecting means.

A more specific object is to provide a mallet-style putter having a series of stepped concentric circular cavities which enable a golfer to more easily monitor his head position by seeing where his eyes are relative to the side walls of the circular cavities.

Another object is to provide an improved mallet-style putter having a central alignment dot offset from the face of the clubhead to induce the golfer to advance the offset dot through the ball producing an accelerating stroke.

Another object is to provide an improved mallet-style putter which eliminates the problem of conventional sight lines which may appear to be aimed to the right or left by providing a large alignment circle which is simply moved back and forth through the ball.

Another object is to provide an improved mallet-style putter which doubles as a putting training aid by supporting a golf ball on the stepped concentric cavities and retaining the ball thereon through a smooth putting stroke but causing the ball to rock or fall off if the putting stroke accelerates or decelerates too quickly, thereby training the golfer for a smooth and consistent putting stroke.

Finally, it is a further object of the invention to provide an improved mallet-style putter which is simple and rugged in construction, attractive in appearance and efficient in operation.

SUMMARY OF THE INVENTION

The mallet-style putter of the present invention has a plurality of stepped concentric circular cavities formed in the top surface of the clubhead. The cavities are preferably transversely centered relative to the clubhead with the center of the cavities offset from the club face by a dimension greater than the radius of the largest diameter cavity so as to impart perimeter weighing to the clubhead. A central alignment dot may be provided on the clubhead concentric with the circular cavities so as to be necessarily offset rearwardly from the front face of the club. The player thus intuitively moves the offset alignment dot through the ball, producing an accelerating putting stroke. The upright side walls of the concentric channels enable the golfer to easily monitor his head position by the shadows or thickness of the side walls that he sees when looking down at the top of the clubhead. The large circles defined by the concentric cavities facilitate alignment, enabling the golfer to simply move the large circle back and forth through the ball.

The diameters and depths of the concentric circular cavities are such that a golf ball may be partially received and supported thereon throughout a smooth putting stroke while causing the golf ball to rock out of position or fall off the clubhead if the putting stroke accelerates or decelerates too quickly. More specifically, the diameters and depths of the circular cavities are preferably such that the bottom of a golf ball supported on the cavities is situated below the top of the top surface of the clubhead by a dimension equal to between ⅛th and ¼th the diameter of the golf ball preferably about 3/16th of that diameter. The golf ball is preferably supported on the top circular edge of a relatively small diameter cavity so that the ball can be rocked out of its seated position rather easily during a wobbly or jerky putting stroke.

The putter head is preferably precisely machine from a 2011 aluminum-alloy to present an attractive machine finish which increases durability while decreasing glare. A preferably fully cambered sole prevents snagging and adjusts for varying terrain. Different shaft lengths may be provided to accommodate individual golfers.

Thus this single putter not only provides improved alignment and a tendency to properly accelerate through the ball during normal play, it alternatively serves as a training aid by receiving a golf ball on the clubhead in a manner to retain it only throughout a smooth putting stroke while causing it to rock or fall off if the putting stroke accelerates or decelerates too quickly.

DESCRIPTION OF THE PREFERRED EMBODIMENT

Figure 1:
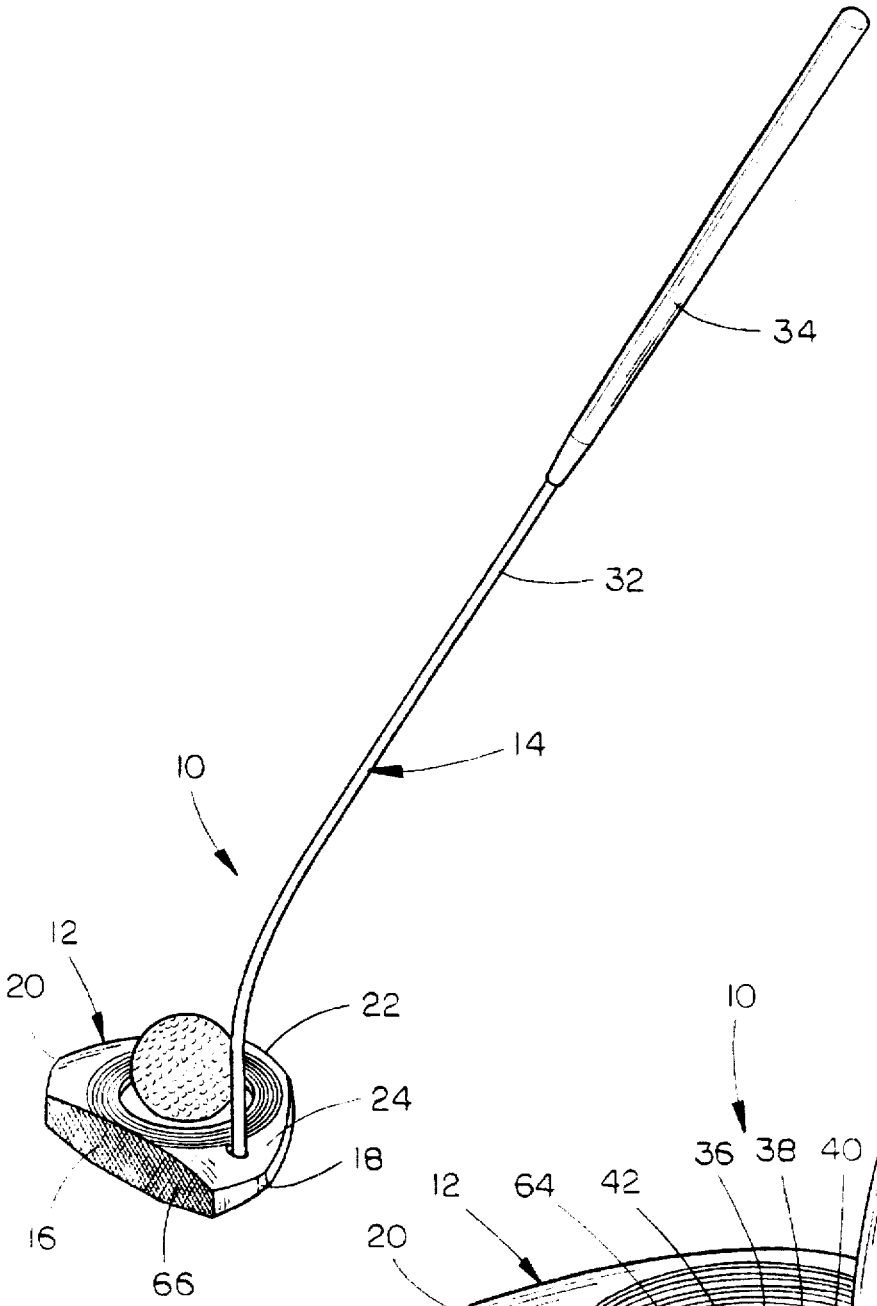
FIG. 1 is a perspective view of the mallet-style putter of the invention when a golf ball supported on the clubhead thereof.
Figure 2:
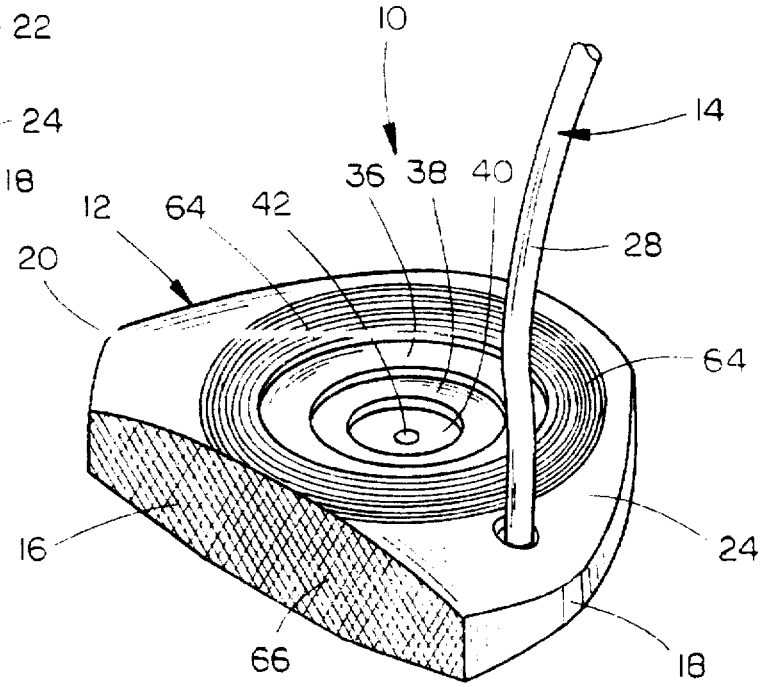
FIG. 2 is an enlarged perspective view of the clubhead and lower end of the shaft, showing the series of stepped concentric cavities in the top surface of the clubhead.

The putter/training aid 10 of the present invention is illustrated in FIGS. 1 and 2 as including a clubhead 12 and shaft 14. The clubhead has a transversely extended upright flat face 16, opposite heel and toe ends 18 and 20, rearward end 22 and top and bottom surfaces 24 and 26.

In the illustrated embodiment, shaft 14 has a bent lower portion 28 which is press fit into an upright shaft receiving bore 30 through the clubhead top surface 24 at a position adjacent the heel end 18 of the clubhead 12. The shaft extends upwardly and outwardly from the clubhead forming a straight top portion 32 of the shaft which receives a grip 34 thereon as shown.

Figure 3:
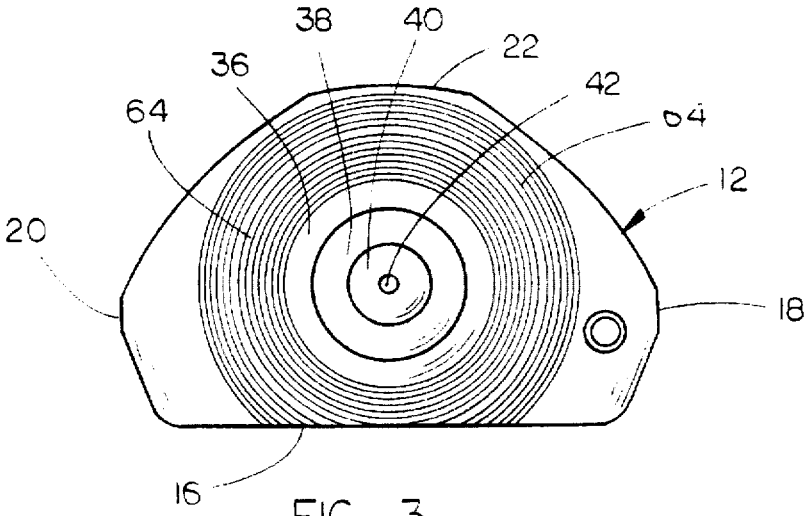
FIG. 3 is a top plan view of the clubhead.
Figure 4:
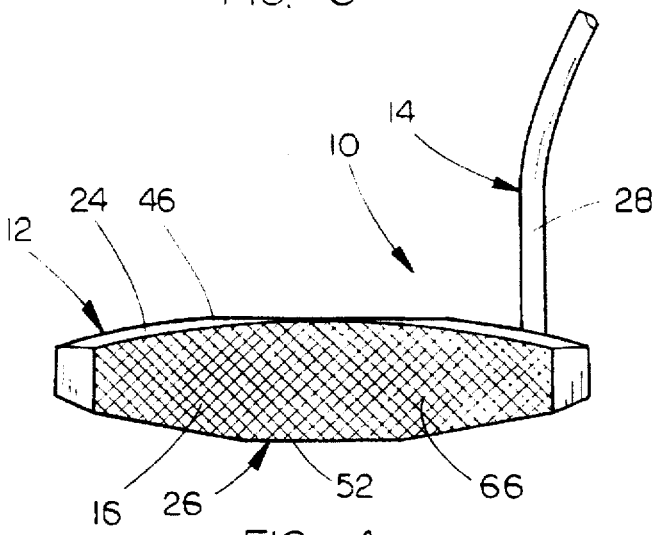
FIG. 4 is a front elevational view of the clubhead and lower portion of the shaft.
Figure 5:
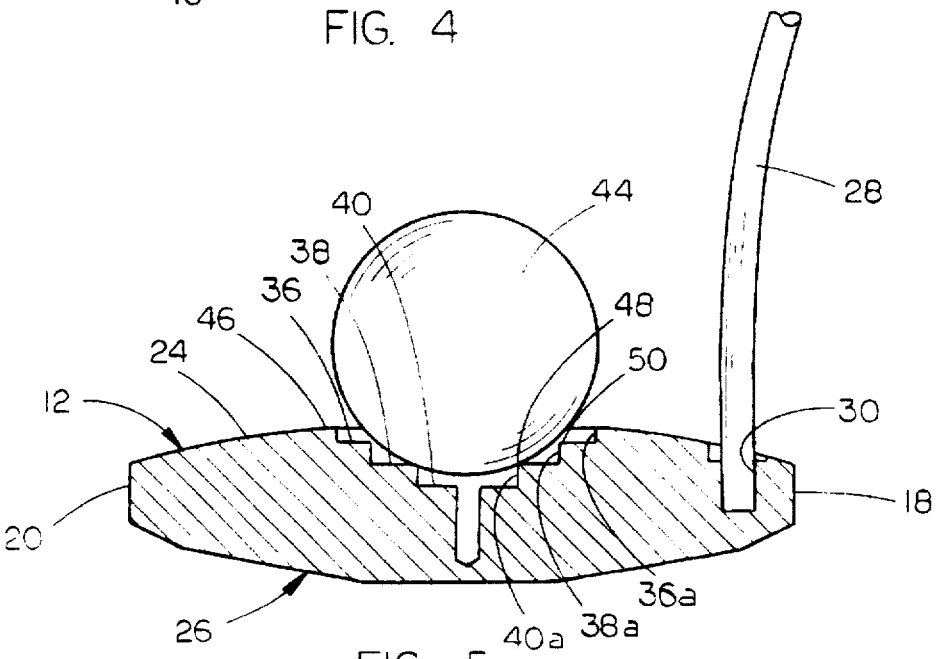
FIG. 5 is a sectional view through the clubhead showing the cross-sectional shape of the stepped concentric cavities, alignment dot and shaft receiving bore.

In FIGS. 2, 3, and 5, there is shown a plurality of stepped concentric circular cavities formed in the top surface. These include an outermost largest diameter cavity 36, an intermediate cavity 38 and an innermost smallest diameter cavity 40. A very small diameter bore is formed in the clubhead concentric with cavities 36, 38 and 40 to define a central alignment dot, the purpose and use of which is described below.

The diameters and depths of the various cavities 36, 38 and 40 are illustrated in FIG. 5 in relation to a conventional golf ball 44. In the United States, a regulation golf ball must weigh no more than 1.62 oz and measure at least 1.68", or 4.27 cm in diameter. The series of cavities 36, 38 and 40 are transversely centered relative to the clubhead and offset rearwardly from the club face 16 for a number of reasons. First, the generally centered position of the stepped concentric circles enables a golfer to more easily monitor his or her head position by seeing where his or her eyes are relative to the peripheral side walls of the cavities. For example, if the putter prefers a head position with his or her eyes directly above the clubhead at the point of impact with a golf ball, the peripheral side walls 36*a*, 38*a* and 40*a* of the respective cavities 36, 38 and 40 should appear as thin uniform circular lines. If the putter's head position is offset in any given direction, the width of the peripheral side walls 36*a*, 38*a* and 40*a* toward the opposite side of the clubhead will be exaggerated in width compared to that portion of the side walls on the near side of the club, thereby providing a ready indication of the displacement of the putter's head from the intended position.

Secondly, by offsetting the series of stepped cavities, 36, 38 and 40 rearwardly from the putter face 16, the central alignment dot 42 is offset substantially rearwardly of the putter face. During the putting stroke, the golfer intuitively moves this offset central alignment dot through the ball thereby necessarily producing an accelerating stroke.

Thirdly, the generally centered position of the stepped concentric cavities 36, 38, and 40 relative to the clubhead provides perimeter weighing for improved balance and a larger sweetspot.

Finally, the rearward offset of the series of stepped cavities 36, 38 and 40 eliminates the problem of conventional sightlines which often appear to be aimed to the right or left depending on right or left eye dominance and/or head position of the golfer. With the large alignment circle defined by peripheral side wall 36*a* of the outermost cavity 36 being substantially the same diameter as a golf ball, one simply moves that circle back and forth through the ball for true and accurate alignment.

The relative diameters and depths of the circular cavities 36, 38 and 40 are best shown for the illustrated embodiment in FIG. 5. Those diameters and depths are such that the bottom of a golf ball supported on the cavities is situated below the top edge 46 of top surface 24 by a dimension equal to between ⅛th and ¼th the diameter of a golf ball. It is furthermore preferred that the circular line of contact between the clubhead and ball is afforded by the upper circular edge 48 of the innermost smallest diameter cavity 40 rather than the substantially larger diameter and more stable support that would be provided by the upper edge 50 of intermediate cavity 38. The relative diameters and depths of those circular cavities are selected so that the cavities are operative to partially receive and support a golf ball thereon throughout a smooth putting stroke while enabling the golf ball to rock out of position and even fall off the club head if the putting stroke accelerates or decelerates too quickly. The direction that a ball travels when being dislodged from the cavities during a faulty putting stroke will likewise be indicative of the misdirection or relative acceleration or deceleration of the clubhead.

Figure 6:
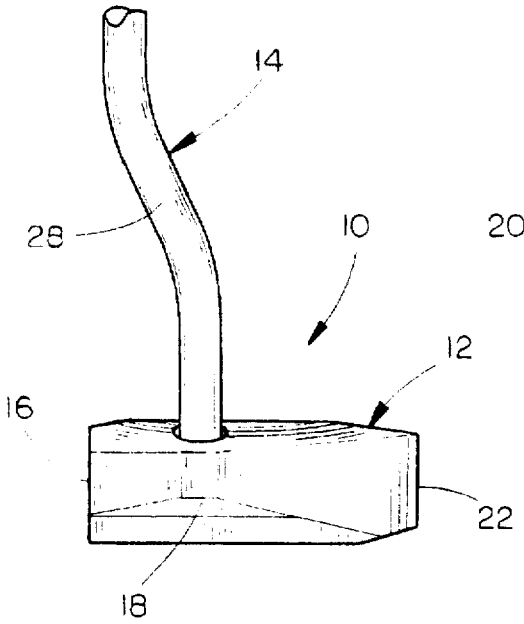
FIG. 6 is a side view of the heel end of the clubhead and lower portion of the shaft.
Figure 7:
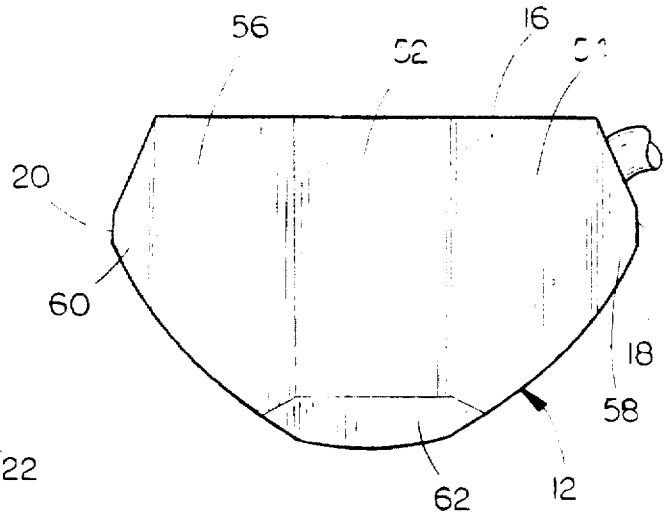
FIG. 7 is a bottom plan view of the clubhead and lower portion of the shaft.
Figure 8:
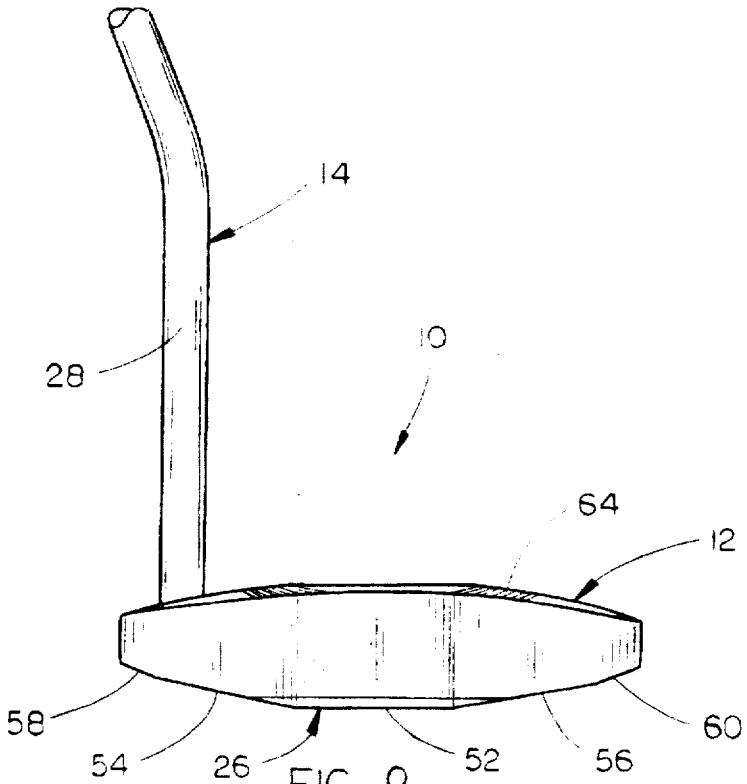
FIG. 8 is a rear elevational view of the clubhead and lower portion of the shaft.
Figure 9:
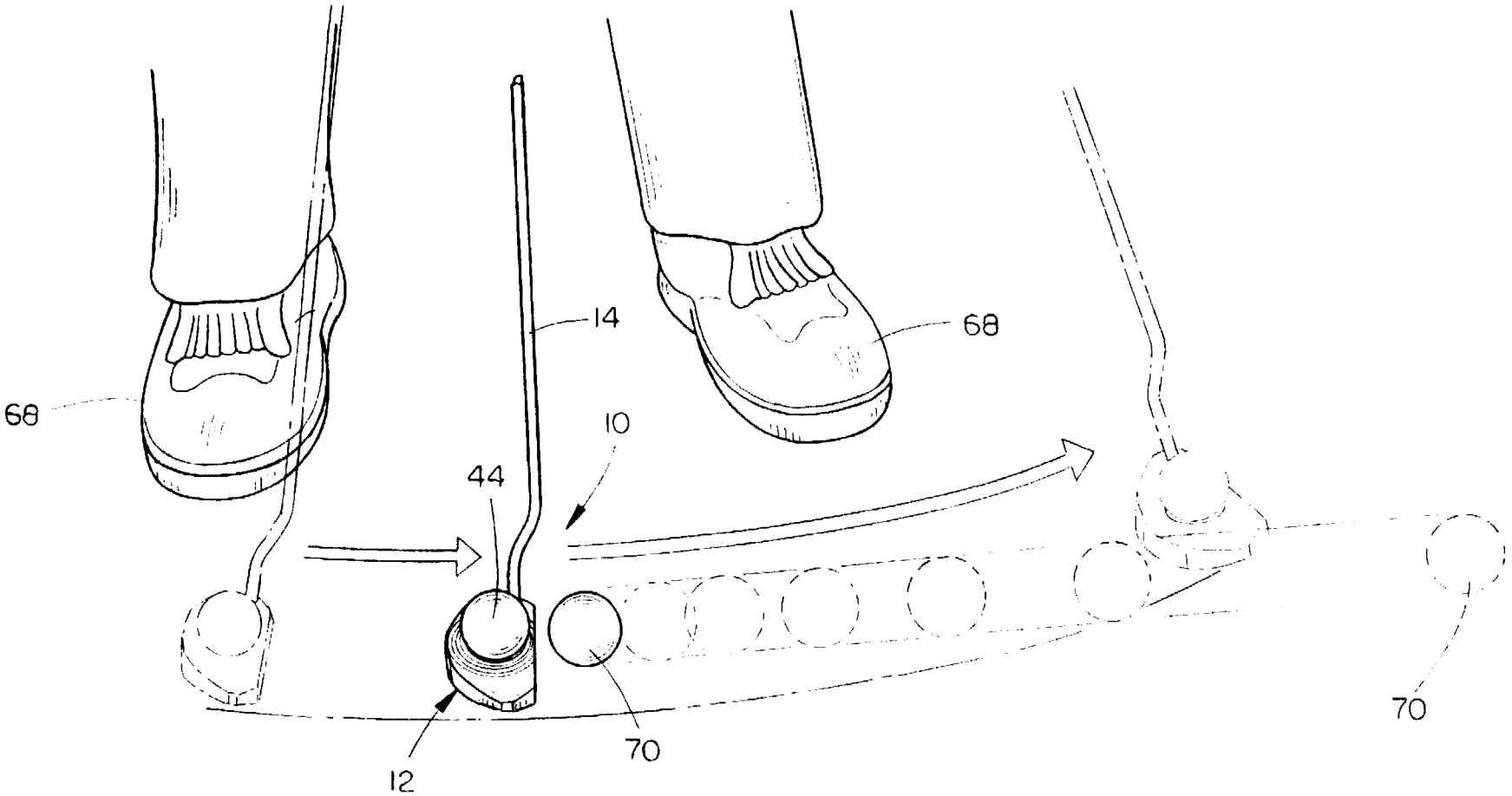
FIG. 9 is a diagrammatic view of the putter in use as a training aid to promote acceleration of the clubhead through the putting stroke.

Further details of construction of the clubhead 12 are evident in the various drawing figures. The sidewalls of the clubhead at the heel end 18 and toe end 20 flare outwardly and rearwardly from the face 16 and then taper rearwardly along a curved rearward end 22. The bottom surface 26 has a flat central portion 52, upwardly and outwardly inclined side portions 54 and 56 and outermost cambered surfaces 58 and 60 at the heel and toe ends 18 and 20 respectively. FIG. 6 illustrates that the bottom surface is likewise cambered at 62 adjacent rearward end 22. Some minimal camber is likewise preferred along the forward edge of bottom surface 26 to cooperate with the other cambered surfaces to prevent snagging and adjust for varying terrain.

The upright peripheral side walls 36*a*, 38*a* and 40*a* of the concentric cavities are preferably vertical as in the illustrated embodiment when the clubhead is rested on a horizontal surface.

A series of concentric circular grooves 64 are formed in the top surface 24 concentric with the cavities 36, 38 and 40 to further facilitate visual alignment of the clubhead relative to a golf ball to be struck. Such alignment is facilitated by the intersection of those grooves 64 with the putter face 16 shown best in FIG. 3. The face 16 may be knurled as indicated at 66 in FIGS. 1 and 2.

FIG. 6 illustrates the use of the putter 10 as a training aid. The golfer properly positions his feet 68 for addressing a golf ball 70 for a putt. A second golf ball 44 is placed on the clubhead for support concentrically of the cavities 36, 38 and 40, as described above. At address, the clubhead is positioned to align the carried ball 44 with the ball 70 in the same manner that alignment is done with the outer periphery of the outermost cavity 36 when no ball 44 is carried on the putter. The golfer executes his back stroke and then advances the clubhead 12 toward the ball 70. If a jerky motion is used at the back of the back stroke, the carried ball 44 will rock on the putter head or fall from it. During a smooth putting stroke, the center of the carried ball 44 serves as the alignment dot which is offset rearwardly from the putter face 16. As the golfer intuitively moves the offset alignment dot or center of the carried ball 44 through the ball 70, an accelerating stroke is naturally produced. Likewise, at the point of impact, if the putting stroke is so tentative that the motion of the club is altered by impact, the carried ball 44 will rock on the clubhead or fall from it. During a smooth putting stroke, on the other hand, the clubhead will be accelerated forwardly through the ball 70 directing it toward the cup as the clubhead moves forwardly carrying the ball 44 in stationary relation thereon.

Thus there is provided an improved putter or other golf club wherein the series of stepped concentric circular cavities in the top surface thereof perform multiple functions for monitoring head position, properly aligning the club face, intuitively inducing an accelerating stroke and even supporting a carried ball 44 to serve as a training aid for identifying any lack of smoothness in a golfer's putting stroke.

Whereas the invention has been shown and described in connection with a preferred embodiment thereof, it is apparent that many modifications, additions and substitutions may be made which are within the intended broad scope of the appended claims. For example, the precise dimensions of the concentric cavities are not critical to the invention but rather, they are preferred as having been shown to accomplish the alignment and carried ball support functions for which they were designed. Likewise, whereas the invention is illustrated in connection with a mallet-style putter, the clubhead construction including offset concentric stepped circular cavities may also be advantageous for metallic woods and other golf clubs. Thus there has been shown and described an improved golf club having multi-function stepped concentric circular cavities in the top surface thereof which accomplish at least all of the stated objects.

We claim:

1. A mallet-style putter, comprising, a clubhead including a transversely extended upright flat face, opposite heel and toe ends, a rearward end, and top and bottom surfaces, a shaft having a lower end connected to said clubhead adjacent the heel end thereof, said shaft extending upwardly and outwardly from said clubhead, said top surface of said clubhead having a plurality of stepped concentric circular cavities formed therein including at least an uppermost and outermost largest diameter cavity and a lowermost and innermost smallest diameter cavity, said cavities being transversely centered relative to said clubhead with the center of said cavities offset from said club face by a dimension greater than the radius of said largest diameter cavity thereby to impart perimeter weighting to said clubhead, the diameters and depths of said circular cavities being operative to partially receive and support a golf ball thereon throughout a smooth putting stroke of said putter, yet enable said golf ball to rock out of position and fall off the clubhead if the putting stroke accelerates or decelerates too quickly, the diameters and depths of said circular cavities being such that the bottom of a golf ball supported on said cavities is situated below the top of said top surface by a dimension equal to between ⅛th and ¼th the diameter of the golf ball.

2. A golf club, comprising, a clubhead including a transversely extended generally upright flat face, opposite heel and toe and top and bottom surfaces, a shaft having a lower end connected to said clubhead adjacent the heel end thereof, said shaft extending upwardly and outwardly from said clubhead, said top surface of said clubhead having a plurality of stepped concentric circular cavities formed therein, including at least an outermost largest diameter cavity, an intermediate cavity and an innermost smallest diameter cavity, said cavities being offset from said clubhead face thereby to impart perimeter weighting to said clubhead.

3. A mallet-style putter, comprising, a clubhead including a transversely extended upright flat face, opposite heel and toe ends and top and bottom surfaces, a shaft having a lower end connected to said clubhead adjacent the heel end thereof, said shaft extending upwardly and outwardly from said clubhead, said top surface of said clubhead having a plurality of stepped concentric circular cavities formed therein including at least an outermost largest diameter cavity and an innermost smallest diameter cavity, said cavities being transversely centered relative to said clubhead with the center of said cavities offset from said club face by a dimension greater than the radius of said largest diameter cavity thereby to impart perimeter weighing to said clubhead, the diameters and depths of said circular cavities being operative to partially receive and support a golf ball thereon throughout a smooth putting stroke of said putter, yet enable said golf ball to rock out of position and fall off the clubhead if the putting strokes accelerates or decelerates too quickly, and a central alignment dot on said clubhead positioned concentric with said circular cavities.

4. The mallet-style putter of claim 3 wherein said central alignment dot is a bore in said clubhead having a diameter less than the diameter of said innermost smallest diameter cavity.

5. The mallet-style putter of claim 3 wherein each of said concentric circular cavities defines an upright peripheral sidewall having upper and lower circular edges, which upright peripheral sidewall facilitates proper positioning of a golfer's eyes relative to said side wall.

6. The mallet-style putter of claim 4 wherein said upright peripheral side walls are vertically oriented upon placement of the bottom surface of said clubhead on a horizontal surface.

7. The mallet-style putter of claim 4 wherein the diameters and depths of said circular cavities are such that the bottom of a golf ball supported on said cavities is situated below the top of said top surface by a dimension equal to between ⅛th and ¼th the diameter of the golf ball.

8. The mallet-style putter of claim 6 wherein said plurality of stepped concentric cavities further includes an intermediate cavity between said outermost and innermost cavities, the diameters of said outermost, intermediate and innermost cavities being such that a golf ball placed onto said cavities is supported by the upper circular edge of the upright peripheral side wall of the innermost cavity.

9. The mallet-style putter of claim 7 wherein the bottom surface of said clubhead is cambered on at least the toe, heel, and rearward end of said clubhead.

10. The mallet-style putter of claim 8 further comprising a plurality of circular concentric grooves formed in the top surface of said clubhead, concentric with said stepped concentric circular cavities, a plurality of said grooves intersecting said flat face of the clubhead.

11. The mallet-style putter of claim 9 further comprising knurling on the flat front face of said clubhead.

* * * * *